US012089727B2

(12) United States Patent
Liu

(10) Patent No.: US 12,089,727 B2
(45) Date of Patent: Sep. 17, 2024

(54) RING HOLDER

(71) Applicant: Megix Technology Asia Co., LTD, Hong Kong (HK)

(72) Inventor: Junjun Liu, Shenzhen (CN)

(73) Assignee: Megix Technology Asia Co., LTD, Hong Kong (HK)

( * ) Notice: Subject to any disclaimer, the term of this patent is extended or adjusted under 35 U.S.C. 154(b) by 0 days.

(21) Appl. No.: 18/408,700

(22) Filed: Jan. 10, 2024

(65) Prior Publication Data

US 2024/0138553 A1 May 2, 2024

(51) Int. Cl.
*A45F 5/10* (2006.01)
*A45F 5/00* (2006.01)

(52) U.S. Cl.
CPC ..... *A45F 5/10* (2013.01); *A45F 2005/008* (2013.01); *A45F 2200/0516* (2013.01)

(58) Field of Classification Search
CPC ..... A45F 2200/0516; A45F 2200/0525; H04B 2001/3861; H04M 1/0281; F16M 13/04
See application file for complete search history.

(56) References Cited

U.S. PATENT DOCUMENTS

| | | | | |
|---|---|---|---|---|
| 9,723,910 | B2 * | 8/2017 | Due | A45F 5/00 |
| 10,555,597 | B2 * | 2/2020 | Mody | A45F 5/00 |
| 10,581,480 | B1 * | 3/2020 | Kim | A45F 5/00 |
| 10,784,914 | B1 * | 9/2020 | Kim | H04M 1/725 |
| 2015/0257288 | A1 * | 9/2015 | Livernois | H04B 1/3877 248/346.06 |
| 2018/0220782 | A1 | 8/2018 | Mody et al. | |
| 2019/0191830 | A1 | 6/2019 | Ruiz | |
| 2022/0045708 | A1 | 2/2022 | You | |

FOREIGN PATENT DOCUMENTS

CN 213746046 U * 7/2021

* cited by examiner

*Primary Examiner* — Dean J Kramer

(57) ABSTRACT

The present disclosure relates to a ring holder. The ring holder includes a rotary base, a moveable seat and a ring body. The rotary base and the moveable seat are horizontally rotatably connected, and the ring body and the moveable seat are longitudinally rotatably connected by means of a rotating assembly. The ring holder further includes a limit piece configured to limit an opening angle of the ring body. The limit piece is connected to the rotating assembly by means of a connection piece. The ring holder is simple in overall structure and is convenient to operate. The ring body not only can rotate around the rotating axis of the rotating assembly, but also can perform circumferential motion along with the rotary base, whereby achieving 360 degrees of position adjustment. The adaptability is higher, and the user experience is better.

9 Claims, 5 Drawing Sheets

RING HOLDER

TECHNICAL FIELD

The present disclosure relates to the technical field of ring holders, more particularly to a ring holder.

BACKGROUND

In order to hold electronic products such as mobile phone more conveniently and firmly, people often attach a ring holder on the back of the mobile phone and then extend a finger into the ring to effectively prevent the occurrence of mobile phone falling off due to untight holding. With the growing expansion of the market, many ring holders of different structures have gradually emerged and their functions are becoming increasingly diverse too. However, for present ring holders, in addition to the basic functions of auxiliary holding or fixing and supporting, aesthetic appearance and playability are also becoming important measuring factors for people to choose the products. Furthermore, with the gradual popularization of electronic products such as mobile phone, ring holders are also gradually becoming one of the frequently used articles in people's daily life. Therefore, ring holders have a very large market potential.

At present, most of the ring holders available on the market only have the ring body rotatable to achieve unfolding and storage. When the electronic device or other articles in use need to be adjusted to be supported in a different angle, the present ring holders cannot achieve the supporting function of the corresponding angle since the ring body cannot be adjusted in position, which greatly reduces the user experience. Therefore, it is necessary to improve the present ring holders.

SUMMARY

In view of the shortcomings of the related art, it is an object of the present disclosure to provide a ring holder which can well solve the above problems.

In order to achieve the above object, the present disclosure solves the technical problems employing the following technical scheme.

A ring holder is provided, including a rotary base, a moveable seat and a ring body. The rotary base and the moveable seat are horizontally rotatably connected, and the ring body and the moveable seat are longitudinally rotatably connected by means of a rotating assembly. The ring holder further includes a limit piece configured to limit an opening angle of the ring body. The limit piece is connected to the rotating assembly by means of a connection piece.

According to the ring holder of the present disclosure, the rotating assembly includes a fixed piece arranged on the moveable seat and a moveable piece arranged on the ring body. The fixed piece is provided with a first extension part, the moveable piece is provided with a second extension part, the first extension part and the second extension part are longitudinally rotatably connected by means of a rotating shaft, and the connection piece is connected to the rotating shaft.

According to the ring holder of the present disclosure, the rotating shaft is provided with extension sections at two ends thereof, and two connection pieces are provided that are detachably connected to the two extension sections respectively. When assembled in place, the first extension part and the second extension part are both positioned between the two connection pieces.

According to the ring holder of the present disclosure, the limit piece includes a fixed plate fixed onto the moveable seat and an extension arm arranged on the fixed plate. The fixed piece and the fixed plate are arranged on upper and lower surfaces of the moveable seat respectively. The extension arm is obliquely upward, the second extension part is circumferentially formed with a receding groove corresponding to the extension arm, and the receding groove is coaxial with the rotating shaft.

According to the ring holder of the present disclosure, the extension arm, the connection piece and the fixed plate are of one-piece structure.

According to the ring holder of the present disclosure, the rotary base is convexly provided with a round platform on an upper end thereof, and the moveable seat has a bottom surface formed with a through hole mated with the round platform. The ring holder further includes a limit plate arranged above the through hole. The limit plate has a greater diameter than the through hole, and the limit plate is detachably connected to the round platform.

According to the ring holder of the present disclosure, the round platform has a side wall formed with a first mounting groove. An elastic sheet is arranged inside the first mounting groove, the elastic sheet is arranged along a circumferential direction of the round platform, and the elastic sheet is provided with a protrusion part extending out of the side wall of the round platform. A gap is formed between one side wall of the elastic sheet far away the protrusion part and a side wall of the first mounting groove for the protrusion part to reciprocate radially. The through hole has an inner wall circumferentially and evenly distributed with a plurality of recessed grooves mated with the protrusion part, and when assembled in place, the protrusion part is clamped into the recessed groove.

According to the ring holder of the present disclosure, the rotary base is round and coaxial with the round platform, the moveable seat is disc shaped and coaxial with the through hole.

According to the ring holder of the present disclosure, the upper surface of the moveable seat is formed with a receiving groove configured to receive the ring body, and the receiving groove has a bottom surface provided with a mounting position configured to mount the rotating assembly.

According to the ring holder of the present disclosure, the bottom surface of the moveable seat is formed with a second mounting groove configured to mount the limit piece.

The present disclosure has the following beneficial effects. The ring holder is simple in overall structure and is convenient to operate. The ring body not only can rotate around the rotating axis of the rotating assembly, but also can perform circumferential motion along with the rotary base, whereby achieving 360 degrees of position adjustment. By means of the limit piece, the opening angle of the ring body can be limited, preventing damages due to excessive turning and achieving the purpose of positioning the ring body. The adaptability is higher, and the user experience is better.

BRIEF DESCRIPTION OF THE DRAWINGS

In order to more clearly illustrate the technical schemes in the embodiments of the present disclosure or in the related art, the present disclosure will be described below in further detail in conjunction with the drawings and embodiments. The drawings that are described below are merely part embodiments of the present disclosure, and an ordinary skill in the art may obtain other drawings according to these drawings without paying creative work.

DETAILED DESCRIPTION OF THE EMBODIMENTS

Terms appearing in the description, claims and drawings of the present disclosure, such as "first", "second", "third", "fourth" etc., are merely used to distinguish different objects, rather than to describe specific precedence order. In addition, terms "comprise" and "include" and their any other deformation are intended to cover non-exclusive containing. For example, a process, method, system, product or apparatus containing a series of steps or units is not limited to the clearly listed steps or units, but may optionally include steps or unit that are not clearly listed or that are inherent for the process, method, product or apparatus.

"Embodiment" mentioned in this paper means that the specific features, structures or characteristics described in combination with the embodiment may be included in at least one embodiment of the present disclosure. The above term "embodiment" appearing in different positions of the description does not necessarily refer to the same embodiment, nor is an independent or alternative embodiment mutually exclusive with other embodiments. Those skilled in the art explicitly and implicitly understand that the embodiments described herein may be combined with other embodiments.

"A plurality of" means two or more. "And/or" describes the relationship of associated objects, which may indicate three relationships. For example, A and/or B may indicate the case of only A, the case of both A and B, and the case of only B. The character "/" generally indicates a relationship of "or" between the former and latter associated objects.

In addition, orientational terms such as "upper," "lower", "left", "right", "upper end", "lower end", "longitudinal", etc. are all based on the three-dimensional coordinate mentioned in the present technical scheme, where the positive direction of the axis Z is above, the positive direction of the axis X is right, and the positive direction of the axis Y is front, the plane where the axes X and Y are located is a horizontal plane, and the plane where the axes X and Z or Y and Z are located is a longitudinal plane.

The purpose, the technical scheme and the advantages of the embodiments of the present disclosure will become more clearly understood from the clear and complete description of the technical scheme of the embodiment of the present disclosure below taken in conjunction with drawings in the present disclosure. Apparently, the embodiments described hereinafter are simply part embodiments of the present disclosure, rather than all the embodiments. All other embodiments obtained by those ordinary skill in the art based on the embodiments of the present disclosure without creative work are intended to be included in the scope of protection of the present disclosure.

Figure 1:
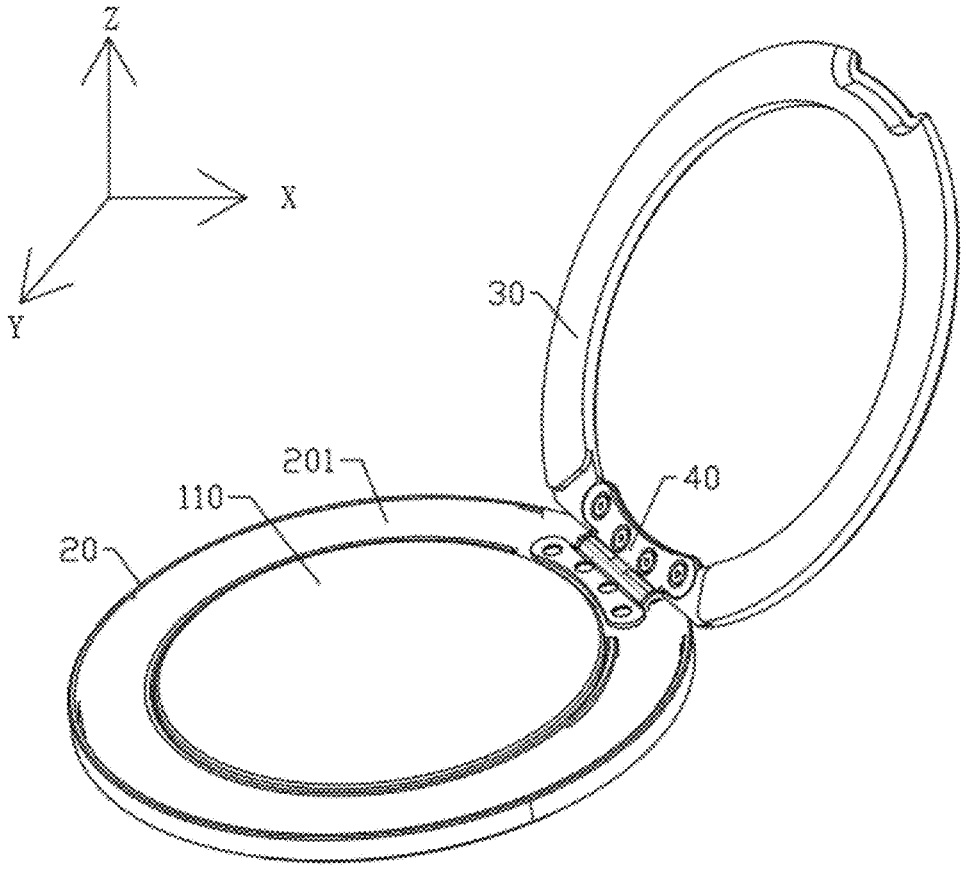
FIG. 1 is an overall structure diagram of a ring holder of the present disclosure.
Figure 2:
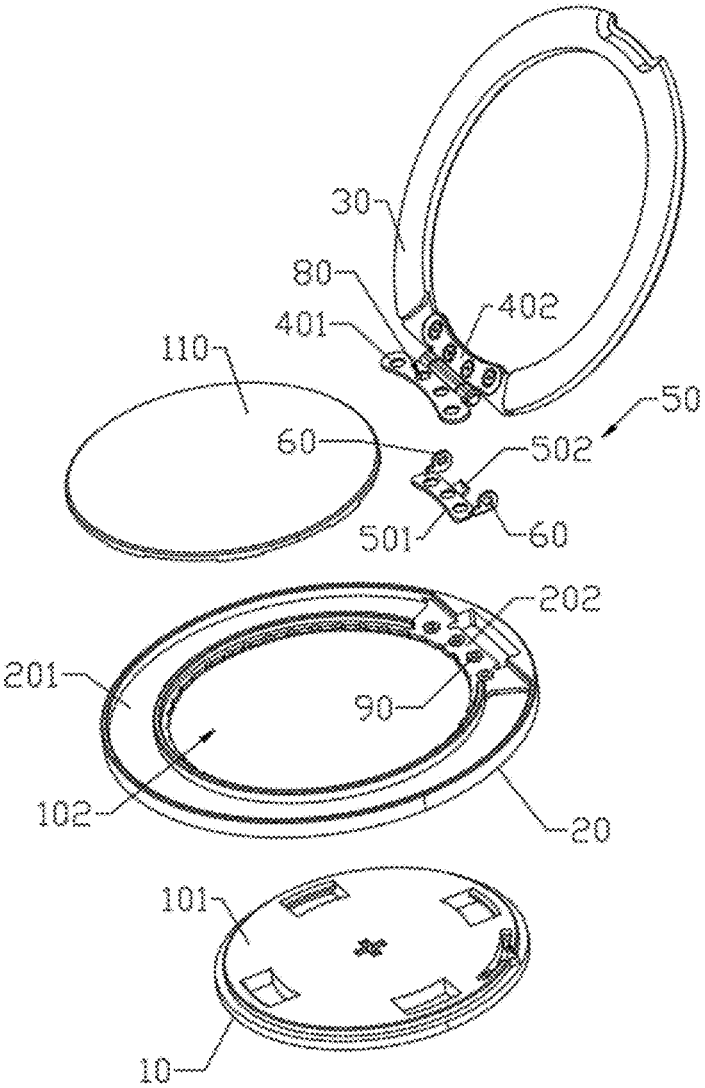
FIG. 2 is an exploded view of FIG. 1.
Figure 3:
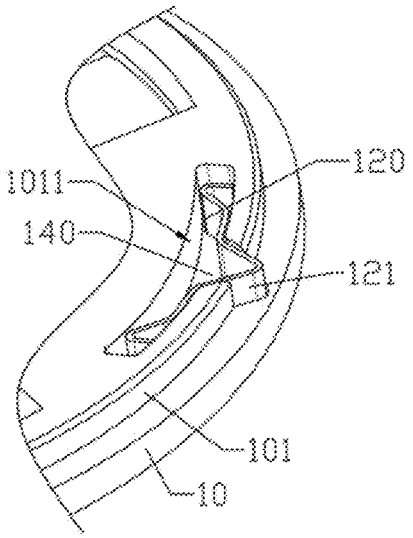
FIG. 3 is an enlargement view of a partial structure of FIG. 2.
Figure 4:
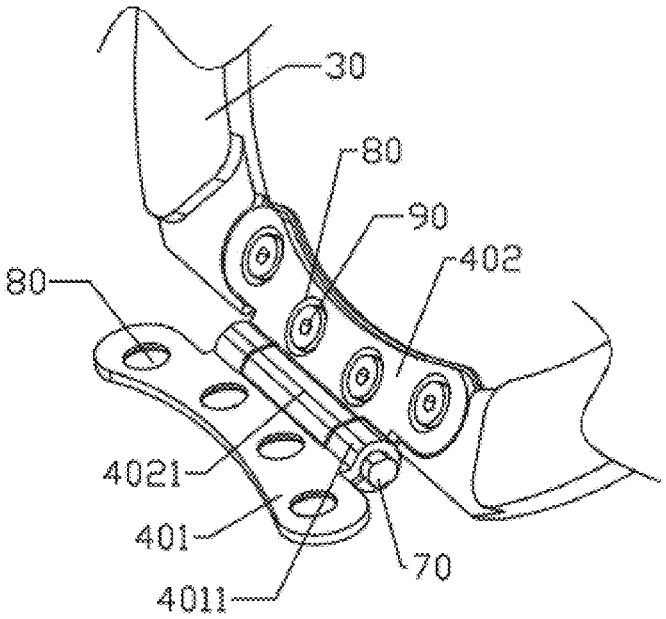
FIG. 4 is an enlargement view of a partial structure of FIG. 2.
Figure 5:
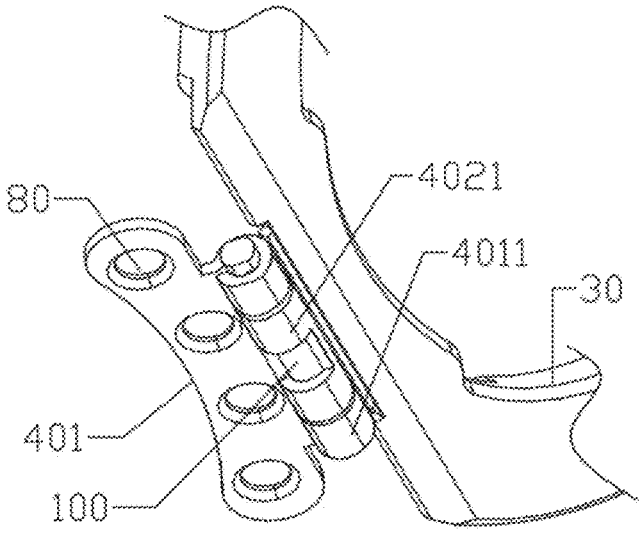
FIG. 5 is a bottom view of FIG. 4.
Figure 6:
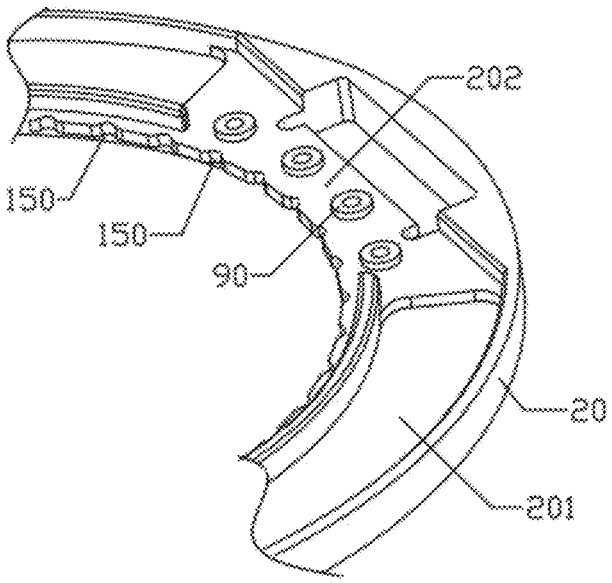
FIG. 6 is an enlargement view of a partial structure of FIG. 2.
Figure 7:
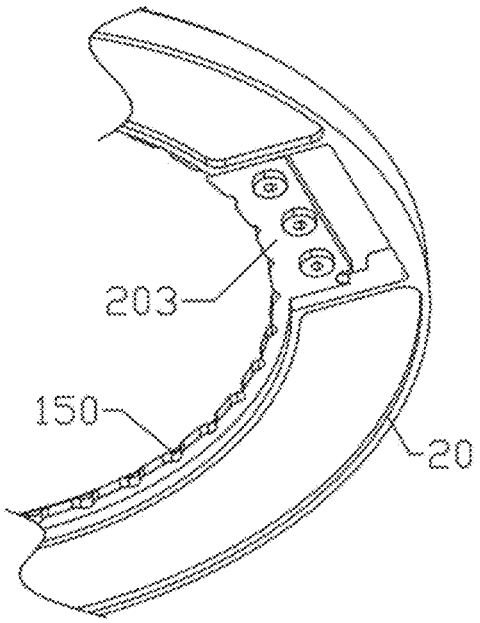
FIG. 7 is a bottom view of FIG. 6.
Figure 8:
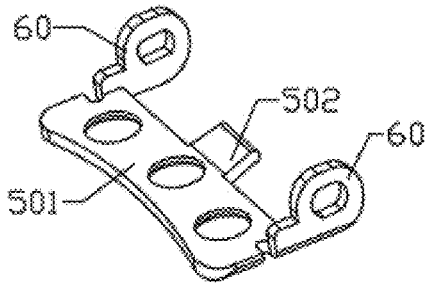
FIG. 8 is an overall structure diagram of a limit piece of a ring holder of the present disclosure.

The ring holder in a preferred embodiment of the present disclosure, as shown in FIGS. 1 to 8, includes a rotary base 10, a moveable seat 20 and a ring body 30. The rotary base 10 and the moveable seat 20 are horizontally rotatably connected, and the ring body 30 and the moveable seat 20 are longitudinally rotatably connected by means of a rotating assembly 40. The ring holder further includes a limit piece 50 configured to limit an opening angle of the ring body 30. The limit piece 50 is connected to the rotating assembly 40 by means of a connection piece 60. The ring holder is simple in overall structure and is convenient to operate. The ring body 30 not only can rotate around the rotating axis of the rotating assembly 40, but also can perform circumferential motion along with the rotary base 10, whereby achieving 360 degrees of position adjustment. When in use, the rotary base 10 is fixed onto a back of an electronic device, for example, being stuck onto a back of a mobile phone. When it is needed to watch videos in landscape mode, the ring body is rotated to a horizontal position to support the mobile phone. When it is needed to watch videos in portrait mode, the mobile phone is adjusted to a vertical state, and the ring body 30 is rotated back to a vertical state by means of the moveable seat 20, whereby the mobile phone can be supported with an oblique state for portrait mode. By means of the limit piece 50, the opening angle of the ring body 30 can be limited, preventing damages due to excessive turning and achieving the purpose of positioning the ring body 30. The adaptability is higher, and the user experience is better.

In the present embodiment, the rotating assembly 40 includes a fixed piece 401 arranged on the moveable seat 20 and a moveable piece 402 arranged on the ring body 30. The fixed piece 401 and the moveable seat 20 are detachably connected. The fixed piece 401 is provided with a first extension part 4011. The moveable piece 402 is provided with a second extension part 4021. The first extension part 4011 and the second extension part 4021 are cylindrical structures formed by integral stamping of the extension parts on the fixed piece 401 and the moveable piece 402 respectively, whereby to achieve the purpose of simplifying processing methods. The first extension part 4011 and the second extension part 4021 are longitudinally rotatably connected by means of a rotating shaft. The connection piece 60 is detachably connected to the rotating shaft, whereby to achieve the purpose of enhancing the supporting function of the limit piece 50 and avoiding a relative displacement with the rotating shaft that may result in failure of positioning of the ring body 30.

In the present embodiment, the rotating shaft is provided with extension sections 70 at two ends thereof, and two connection pieces 60 are provided that are detachably connected to the two extension sections 70 respectively. When assembled in place, the first extension part 4011 and the second extension part 4021 are both positioned between the two connection pieces 60, whereby to achieve the purpose of limiting and clamping the first extension part 4011 and the second extension part 4021, preventing the first extension part 4011 and the second extension part 4021 separating from each other.

In the present embodiment, the limit piece 50 includes a fixed plate 501 fixed onto the moveable seat 20 and an extension arm 502 arranged on the fixed plate 501. The fixed piece 401 and the fixed plate 501 are arranged on upper and lower surfaces of the moveable seat 20 respectively. Specifically, the fixed piece 401 and the fixed plate 501 are both formed with fixing through holes 80, while the upper and lower surfaces of the moveable seat 20 are provided with fixing protrusions 90 mated with the fixing through holes 80, whereby to achieve the purpose of positioning and fixing. In addition, in order to ensure firmness, the fixing protrusion 90 can be further provided with a screw to tightly assemble the fixed piece 401 and the fixed plate 501. The extension arm 502 is obliquely upward, and the second extension part 4021 is circumferentially formed with a receding groove 100 corresponding to the extension arm 502. The receding groove 100 is coaxial with the rotating shaft and is in a semi-circular arc shape. By means of the fitting between a tip end of the extension arm 502 and an inner wall of the receding groove 100, the ring body 30 can be supported in an oblique state, where the degree of oblique can be realized by setting the length of the extension arm 502.

In the present embodiment, the extension arm 502, the connection piece 60 and the fixed plate 501 are of one-piece structure, which specifically is formed by integral punching and stamping to ensure the firmness of the structure.

In the present embodiment, the rotary base 10 is convexly provided with a round platform 101 on an upper end thereof. The moveable seat 20 has a bottom surface formed with a through hole 102 mated with the round platform 101. The ring holder further includes a limit plate 110 arranged above the through hole 102. The limit plate 110 has a greater diameter than the through hole 102, and the limit plate 110 is detachably connected to the round platform 101. The moveable seat 20 is limited onto the rotary base 10 by means of the limit plate 110, whereby the moveable seat 20 is rotatable with the round platform 101 coaxially. Specifically, the round platform 101 can be shaped by forming of a recessed ring step on a side wall of the rotary base, whereby to further reduce the thickness of the overall structure.

In the present embodiment, the round platform 101 has a side wall formed with a first mounting groove 1011. The first mounting groove 1011 extends through a top surface of the round platform 101. An elastic sheet 120 is arranged inside the first mounting groove 1011. The elastic sheet 120 is in an arc shape and is arranged along a circumferential direction of the round platform 101. The elastic sheet 120 has a middle part provided with a protrusion part 121 extending out of the side wall of the round platform 101. A gap 140 is formed between one side wall of the elastic sheet 120 far away the protrusion part 121 and a side wall of the first mounting groove 1011 for the protrusion part 121 to reciprocate radially. The through hole 102 has an inner wall circumferentially and evenly distributed with a plurality of recessed grooves 150 mated with the protrusion part 121. When assembled in place, the protrusion part 121 is clamped into the recessed groove 150. While the moveable seat 20 is rotated, the protrusion part 121 can enter the plurality of recessed grooves 150 circumferentially in turn to form rhythmic clicks, which plays the role of pleasing ears and releasing stress and thus improves the use experience of the product.

In the present embodiment, the rotary base 10 is round and coaxial with the round platform 101, the moveable seat 20 is disc shaped and coaxial with the through hole 102, whereby to achieve the function of beautifying the appearance.

In the present embodiment, the upper surface of the moveable seat 20 is formed with a receiving groove 201 configured to receive the ring body 30, the receiving groove 201 has a bottom surface provided with a mounting position 202 configured to mount the rotating assembly 40, and the bottom surface of the moveable seat 20 is formed with a second mounting groove 203 configured to mount the limit piece 50, whereby the thickness of the overall structure is further reduced, and the structure compactness of the product is ensured.

It should be understood that, for the ordinary skill in this art, multiple improvements or variations may be made according to the above description, all of which are intended to be included within the scope of protection of the claims appended hereinafter.

What is claimed is:

1. A ring holder, comprising a rotary base, a moveable seat and a ring body, wherein the rotary base and the moveable seat are horizontally rotatably connected, and the ring body and the moveable seat are longitudinally rotatably connected by means of a rotating assembly; the ring holder further comprising a limit piece configured to limit an opening angle of the ring body, wherein the limit piece is connected to the rotating assembly by means of a connection piece; the rotating assembly comprises a fixed piece arranged on the moveable seat and a moveable piece arranged on the ring body, the fixed piece is provided with a first extension part, the moveable piece is provided with a second extension part, the first extension part and the second extension part are longitudinally rotatably connected by means of a rotating shaft, and the connection piece is connected to the rotating shaft.

2. The ring holder according to claim 1, wherein the rotating shaft is provided with extension sections at two ends thereof, and two connection pieces are provided that are detachably connected to the two extension sections respectively; when assembled in place, the first extension part and the second extension part are both positioned between the two connection pieces.

3. The ring holder according to claim 1, wherein the limit piece comprises a fixed plate fixed onto the moveable seat and an extension arm arranged on the fixed plate, the fixed piece and the fixed plate are arranged on upper and lower surfaces of the moveable seat respectively, the extension arm is obliquely upward, the second extension part is circumferentially formed with a receding groove corresponding to the extension arm, and the receding groove is coaxial with the rotating shaft.

4. The ring holder according to claim 3, wherein the extension arm, the connection piece and the fixed plate are of one-piece structure.

5. The ring holder according to claim 1, wherein the rotary base is convexly provided with a round platform on an upper end thereof, the moveable seat has a bottom surface formed with a through hole mated with the round platform, the ring holder further comprises a limit plate arranged above the through hole, the limit plate has a greater diameter than the through hole, and the limit plate is detachably connected to the round platform.

6. The ring holder according to claim 5, wherein the round platform has a side wall formed with a first mounting groove, an elastic sheet is arranged inside the first mounting groove, the elastic sheet is arranged along a circumferential direction of the round platform, the elastic sheet is provided with a protrusion part extending out of the side wall of the round platform, a gap is formed between one side wall of the elastic sheet far away the protrusion part and a side wall of the first mounting groove for the protrusion part to reciprocate radially, the through hole has an inner wall circumferentially and evenly distributed with a plurality of recessed grooves mated with the protrusion part, and when assembled in place, the protrusion part is clamped into the recessed groove.

7. The ring holder according to claim 5, wherein the rotary base is round and coaxial with the round platform, the moveable seat is disc shaped and coaxial with the through hole.

8. The ring holder according to claim 1, wherein the upper surface of the moveable seat is formed with a receiving groove configured to receive the ring body, and the receiving groove has a bottom surface provided with a mounting position configured to mount the rotating assembly.

9. The ring holder according to claim 1, wherein the bottom surface of the moveable seat is formed with a second mounting groove configured to mount the limit piece.

* * * * *